United States Patent [19]

Summa

[11] Patent Number: 4,898,099

[45] Date of Patent: Feb. 6, 1990

[54] POSITIVE RETRACTION TROLLEY STOP FOR POWER AND FREE CONVEYORS

[75] Inventor: Gareth D. Summa, Riverside, Mo.

[73] Assignee: Mid-West Conveyor Co., Inc., Kansas City, Mo.

[21] Appl. No.: 283,584

[22] Filed: Dec. 13, 1988

Related U.S. Application Data

[63] Continuation-in-part of Ser. No. 926,672, Nov. 4, 1986, Pat. No. 4,790,247.

[51] Int. Cl.[4] ..... B61B 13/00; B61K 7/00

[52] U.S. Cl. ..... 104/172.4; 104/252

[58] Field of Search ..... 104/172.1, 172.2, 172.3, 104/172.4, 249, 250, 252, 253, 162

[56] References Cited

U.S. PATENT DOCUMENTS

| | | | |
|---|---|---|---|
| 2,496,916 | 2/1950 | Kershaw | 104/252 |
| 3,044,416 | 7/1962 | Reibel et al. | 104/172.4 |
| 3,130,685 | 4/1964 | Goodrich et al. | 104/172.2 |
| 3,195,474 | 7/1965 | Dehne | 104/172.4 |
| 3,418,946 | 12/1968 | Yokoi et al. | 104/172.4 |
| 3,437,054 | 4/1969 | Bishop | 198/465.4 |
| 3,451,352 | 6/1969 | Curry et al. | 104/172 |
| 3,477,390 | 11/1969 | Dolding | 104/172 |
| 3,503,337 | 3/1970 | Haase | 104/172.4 |
| 3,523,504 | 8/1970 | Jones | 104/172.4 |
| 3,559,585 | 2/1971 | Lempio | 104/172 |
| 3,774,546 | 11/1973 | Krammer | 104/172 |
| 3,831,528 | 8/1974 | Redlichs | 104/252 |
| 3,837,289 | 9/1974 | Marshman et al. | 104/172 B |
| 3,934,516 | 1/1976 | Paglia | 104/172.4 |
| 4,644,869 | 2/1987 | Rhodes | 104/172.2 |

FOREIGN PATENT DOCUMENTS

| | | | |
|---|---|---|---|
| 1090577 | 10/1960 | Fed. Rep. of Germany | 104/252 |
| 1170986 | 5/1964 | Fed. Rep. of Germany | 104/250 |
| 2132502 | 1/1973 | Fed. Rep. of Germany | 104/172.4 |

*Primary Examiner*—Andres Kashnikow
*Assistant Examiner*—Virna Lissi Mojica
*Attorney, Agent, or Firm*—Litman, McMahon & Brown

[57] ABSTRACT

A positive retraction trolley stop mechanism is provided for a power and free conveyor system having a trolley member driven along a track. A depending trolley dog, engaged by drive dogs on a drive mechanism to push the trolley along the track, is movable between upper and lower positions for disengagement and engagement with drive dogs. The stop mechanism includes a pivotal stop arm which is pivoted to an upper position to engage a trolley dog on a trolley to be stopped and supported there by a cam member which is pivoted by a piston and cylinder. The cam member is pivoted out from under the stop arm to release the stop arm to assume its lower non-braking position. A one way or lost motion link is connected between cranks on a cam shaft and a stop arm axle to positively pull the stop arm to its non-braking position. The lost motion link is connected to the cam crank by a link connector which slidably engages a slot in the ink.

21 Claims, 3 Drawing Sheets

POSITIVE RETRACTION TROLLEY STOP FOR POWER AND FREE CONVEYORS

CROSS-REFERENCE TO RELATED APPLICATION

This is a continuation-in-part of U.S. patent application, Ser. No. 06/926,672 filed Nov. 4, 1986 entitled TROLLEY STOP FOR POWER AND FREE CONVEYORS, which is now U.S. Pat. No. 4,790,247 and which is incorporated herein by reference.

FIELD OF THE INVENTION

The present invention relates to power and free trolley conveyors and, more particularly, to a positively retracting stop mechanism for trolleys of such a conveyor.

BACKGROUND OF THE INVENTION

Conventional power and free trolley conveyors are characterized by a transport mechanism which includes a trolley mounted on rollers or the like for movement along a track or rail system. Generally, such trolleys have a member extending therefrom which is engaged by a dog member on a chain drive to convey the trolley. In a power and free system, the trolleys may sometimes roll along the tracks freely, even when the dog member on the drive does not engage the trolley. For example, the trolley may be allowed to freely roll along a downhill slope, around a curve, or when being transferred between chain drives. Disengagement between the trolley and the drive dog is desired at points where the trolley is to be stopped, as for example when manufacturing operations, maintenance, or repair access to an object being transferred by the trolley is desired. A carrier member is often mounted on the trolley. The types of carrier members used vary considerably, depending on the nature of the objects to be transported. Various types of carrier members may be used in association with the present invention.

The term "inverted", as in "inverted power and free conveyor", refers to the fact that the drive mechanism which engages the extending member on the trolley runs beneath the track and the trolley. In many conventional systems, the drive mechanism comprises a continuous chain drive with upwardly extending drive dogs thereon. The drive dogs for inverted systems engage a depending member on the trolley to push same. Herein, the depending member on the trolley will be referred to as a trolley dog and the dog on the drive system as a drive dog or pusher dog.

In many systems the trolley dog is vertically movable between upper and lower positions. When in the lower or engaged position, the trolley dog depends low enough to be engaged by pusher dogs being driven underneath the trolley by means of the drive mechanism. On the other hand, when the trolley dog is in the upper or disengaged position, it is generally too high to be reached by the upwardly extending drive or pusher dogs. Therefore, when the trolley dog is in the upper position, the trolley is not positively engaged by the drive dogs and driven.

Many trolley stop arrangements operate by moving the trolley dog between engaged and disengaged positions. For such systems, the trolley dog has a forward cam surface which, when it engages the trolley stop, is cammed upwardly until disengagement from the drive dog is achieved. Typical trolley systems operate by positioning an obstruction in the path of motion of the trolley to urge the trolley dog out of engagement with the pusher dog.

For example, a trolley stop arrangement may utilize a knife blade extending perpendicular to the track of the trolley, sometimes extending completely thereacross, to be engaged by the trolley dog. When withdrawn, the knife blade does not block the path of motion of the trolley dog, and the trolley will, thus, pass the trolley stop under positive drive. On the other hand, when the blade is extended into the path of the trolley dog, it will be engaged thereby, with the camming action lifting the trolley dog and bringing the trolley to a stop.

Such trolley stops, while they have been somewhat effective, have not been completely satisfactory. First, such knife blade arrangements often require portions which extend outwardly from the side of the track or conveyor body. Often a piston for operating the knife blade, a linkage system, or a receptacle for receiving the knife blade extends outward from the side of the track. This not only takes up space which might be more conveniently used but also provides inconvenient and potentially hazardous obstructions to vehicles or personnel moving along the side of the conveyor track. Such systems have not provided for satisfactory, positive braking of the trolley. The trolley comes to a stop primarily because of the friction of the trolley dog rubbing against the knife blade when the trolley dog is disengaged from the drive dog.

U.S. Pat. No. 4,790,247 mentioned above is directed to a trolley stop assembly including a stop arm mounted for pivoting about a transverse axis between a lower trolley non-stopping position and an upper trolley disengaging and braking position. The stop arm is pivoted to the upper position by contact of a pivoted cam with an under side of the stop arm. When the cam is pivoted out from under the stop arm, the stop arm is released to assume its lower position under the influence of gravity. In certain environments, the free pivoting of the stop arm can be degraded by contamination of the stop arm pivot bearing with dirt or other foreign material. For example, in a manufacturing plant in which the trolleys carry parts to be painted, a stop arm pivot bearing of a trolley disengagement and braking assembly near a painting station may become encrusted with paint particles from overspray. When the stop arm is released to allow trolleys to pass by, the stop arm may not fall to its lower position, resulting in unintended disengagement and braking of trolleys.

SUMMARY OF THE INVENTION

A positive retraction trolley stop mechanism according to the present invention includes a frame member mounted underneath the trolley track. The stop arm is mounted on the frame member by a stop arm axle extending through the frame member for pivoting about a horizontal axis transverse to the track or path of motion of the trolleys between a lower trolley engaged position in which trolleys remain engaged with a drive dog of a trolley chain drive and an upper trolley disengaging position in which a trolley dog is pivoted out of engagement with the drive dog. The stop arm includes an upstanding abutment which is engaged by the trolley dog when the arm is in its upper position to positively stop the movement of the trolley.

The stop arm is urged to its upper position by a cam member which is affixed to a cam shaft pivotally mounted on the frame member and connected by a cam crank to a double acting fluid cylinder which is pivotally connected to the frame member. A flat surface on the end of the cam member engages a lower rest surface of the stop arm when the cam is pivoted by the cylinder to an arm raising position to support the stop arm in its upper position even if the cylinder is deactivated. When the cam is pivoted to an arm releasing position by the cylinder, the stop arm is released to drop to its lower trolley engaged position.

In order to insure that the stop arm returns to its lower position when released by the cam member, a lost motion link is engaged between the stop arm and the cylinder. A stop arm crank is affixed to the stop arm axle and has a one way link connected between it and the cam crank. In a preferred embodiment of the present invention, the lost motion link is a slotted link having one end pivotally connected to the stop arm crank and having an elongated slot formed in the other end. The cam crank is engaged with the slot by a sliding link connector.

When the cam crank is pivoted by the cylinder to lift the stop arm to its upper position, the sliding connector slides along the slot toward an inner end of the slot and does not interfere with the lifting of the stop arm by the cam member. When the cylinder is operated to pivot the cam to its stop arm releasing position, engagement between the outer end of the slot and the sliding connector of the cam crank positively pivots the stop arm to its lower position. In an alternative embodiment of the present invention, the slotted link is replaced with a flexible tensile member, such as a chain or cable, which is connected between the stop arm crank and the cam crank. When the cylinder pivots the cam crank to release the stop arm, the chain or cable is pulled taut to thereby pull the stop arm crank and positively pivot the stop arm to the lower trolley engaged position.

The combination of the flat ended cam member and the lost motion link between the cylinder and the stop arm allows the stop arm to be supported with stability in its upper trolley disengaging position without the cylinder being active and insures positive pivoting of the stop arm to its lower trolley engaged position. In contrast, a direct pivotal connection of the cylinder to the stop arm would positively pivot the stop arm to its lower position but would require that the cylinder remain pressurized to maintain the stop arm in its upper position.

OBJECTS OF THE INVENTION

The principal objects of the present invention are: to provide a trolley stop mechanism especially suited for use with power and free trolley conveyor systems; to provide such a trolley stop mechanism potentially utilizable with either overhead or inverted power and free systems; to provide such a trolley stop mechanism characterized by a stop arm pivotally mounted therein to move between a braking position to selectively disengage and stop a trolley and a non-braking position to allow trolleys to pass; to provide such a stop arm with an upper cam surface engageable with a trolley dog on a trolley to cam same out of engagement with an associated drive dog to disengage the trolley from the drive mechanism; to provide such a mechanism having such a stop arm which is pivotally mounted about a horizontal axis transverse to a path of motion of trolleys along the track; to provide such a stop arm in which the stop arm upper cam surface includes an abutment engagable with the trolley dog to positively brake the trolley; to provide a trolley stop mechanism with an actuator including a cam member pivotably mounted within the mechanism to pivot the stop arm into engagement with the trolley dog to disengage and stop the trolley; to provide such a mechanism wherein the cam member is pivotable to bias the stop arm out of possible stopping contact with the trolley dog; to provide such a mechanism wherein the cam member is pivoted by a piston and cylinder arrangement; to provide such a mechanism which positively retract the stop arm to its lower position to prevent undesired disengagement and braking of trolleys; to provide such a mechanism including a one way or lost motion linkage connected between the stop arm and the stop arm actuator which allows the cam member to support the stop arm in an upper trolley disengaging and braking position without the actuator cylinder being pressurized and which positively pivots the stop arm to its lower position out of possible engagement with trolleys passing thereby; to provide such a mechanism wherein the stop arm and cam member are positioned in an inverted power and free system beneath trolley members and above the system's drive mechanism; to provide such a mechanism wherein neither the trolley stop arm nor the cam member extends across a path of movement of the trolley; to provide such a mechanism wherein both the stop arm and the cam member are mounted for pivoting about transverse horizontal axes; to provide such a mechanism wherein engagement between a cam member end and the stop arm is such that the stop arm is supported with stability in the trolley stopping position without positive activation of the piston and cylinder arrangement; and to provide such a positive retraction trolley stop mechanism which is economical to manufacture, positive and durable in operation, and which is particularly well adapted for its intended purpose.

Other objects and advantages of this invention will become apparent from the following descriptions taken in connection with the accompany drawings, wherein are set forth by way of illustration examples of certain embodiments of this invention.

The drawings constitute a part of this specification and include exemplary embodiments of the present invention, to illustrate various objects and features thereof.

DETAILED DESCRIPTION OF THE INVENTION

Figure 1:
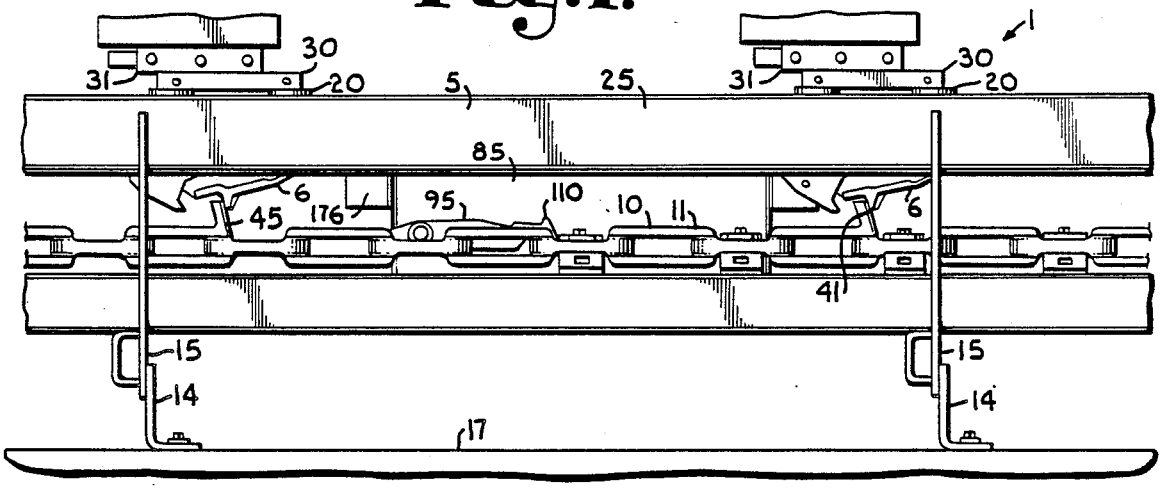
FIG. 1 is a fragmentary side elevational view of a type of inverted power and free trolley conveyor system in which a positive retraction trolley stop mechanism embodying the present invention is incorporated.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but rather merely as a basis for the claims and as a representative basis for teaching one skilled in the art to employ the present invention in virtually any appropriately detailed structure.

Referring to the drawings in more detail:

The reference numeral 1, FIG. 1, generally designates a conveyor system incorporating a positive retraction trolley stop mechanism 2 (FIGS. 8–10) embodying the present invention. Before the stop mechanism 2 is described, the conveyor system 1 in which the mechanism 2 is employed will be described. The conveyor system 1 includes a track 5 in which trolleys 6 ride, the track 5 defining a path of motion for the trolleys about a warehouse, assembly plant, or the like. The trolleys 6 are powered by a drive mechanism 10, such as a continuous chain drive 11 described in further detail below. The conveyor system 1 includes supports 14 which engage frame members 15 to support the track 5, trolleys 6, and drive mechanism 10 above a floor 17 of the workplace in a conventional manner. A variety of support means may be utilized in association with the present invention.

Figure 2:
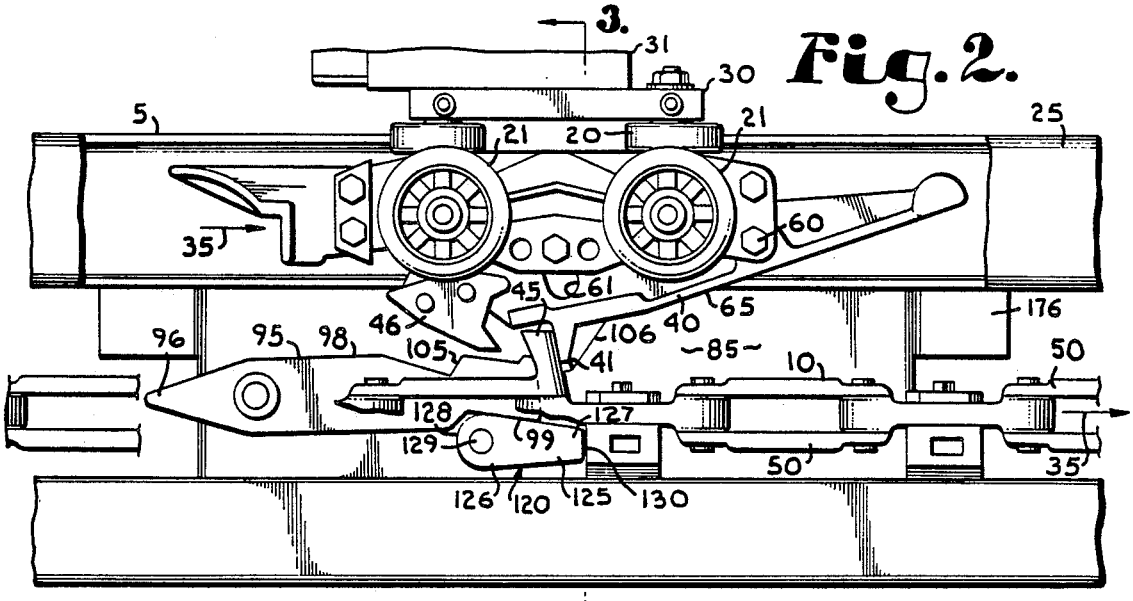
FIG. 2 is an enlarged fragmentary side elevational view of a gravity retraction stop assembly with portions broken away to show internal details thereof.
Figure 3:
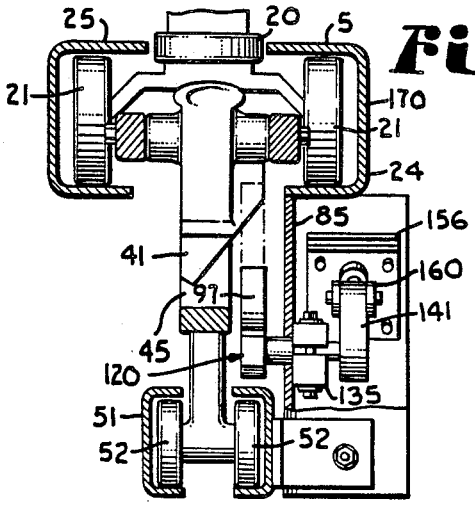
FIG. 3 is an enlarged fragmentary transverse sectional view taken along line 3—3 of FIG. 2 and illustrates details of the gravity retracted stop arm.
Figure 7:
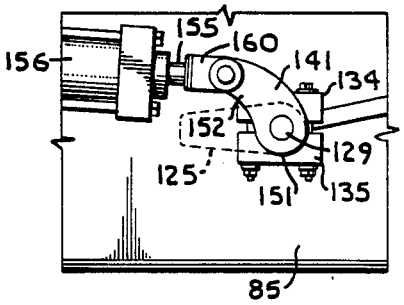
FIG. 7 is a fragmentary view similar to FIG. 6 and illustrates the actuating cam in a stop arm releasing position in phantom lines.
Figure 4:
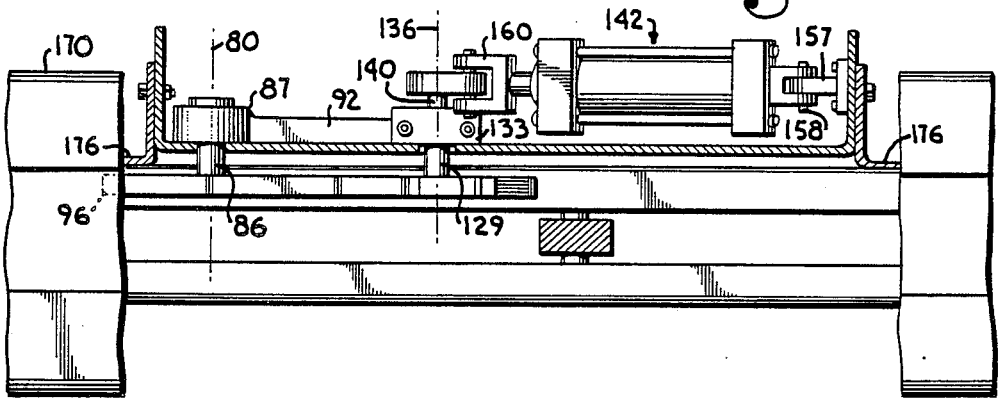
FIG. 4 is an enlarged fragmentary top plan view of the gravity retracted stop arm with portions broken away to show details thereof.

Referring to FIGS. 1, 2 and 3, each trolley 6 includes a truck 20 mounted on a plurality of rollers 21 and may be of a conventional design. The rollers 21 engage the track 5 to transport the truck 20 therealong. The track 5 is formed by inwardly facing first and second channel shaped halves 24 and 25 (FIG. 3). Each trolley 6 includes an upper portion 30 adapted to carry whatever objects are to be transported by the conveyor. Details concerning this are not shown, as any of a variety of systems may be utilized in association with the present invention. In FIG. 1, the upper portion 30 of each trolley 6 includes a carrier member 31 which receives objects to be transported.

Referring to FIG. 2, trolley 6 moves along the track 5 in the direction of arrows 35 and includes a pivotable trolley dog 40 engageable by the drive mechanism 10. The trolley dog 40 includes an extension 41 thereon which, for inverted system, projects downwardly and is engageable by the drive mechanism 10. The chain drive 11 includes drive or pusher dogs 45 which extend upwardly from the chain drive 11 to engage the downward extensions 41 on the trolley dogs 40. As the chain 11 is driven in the direction of arrows 35, the drive dogs 45 are driven in the same direction and eventually encounter the extension 41 of the trolley dog 40 thereby pushing the trolley 6 along the track 5. The trolley 6 includes a rear latch member or backup dog 46 thereon which slides in behind the drive dogs 45 to prevent the trolley 6 from rolling forward out of engagement with the drive dogs 45 of the drive mechanism 10. The continuous chain drive 11 includes a plurality of chain links 50 guided along lower track 51 by rollers 52. A power means such as an electric motor (not shown) is used to drive the chain 11.

Figure 5:
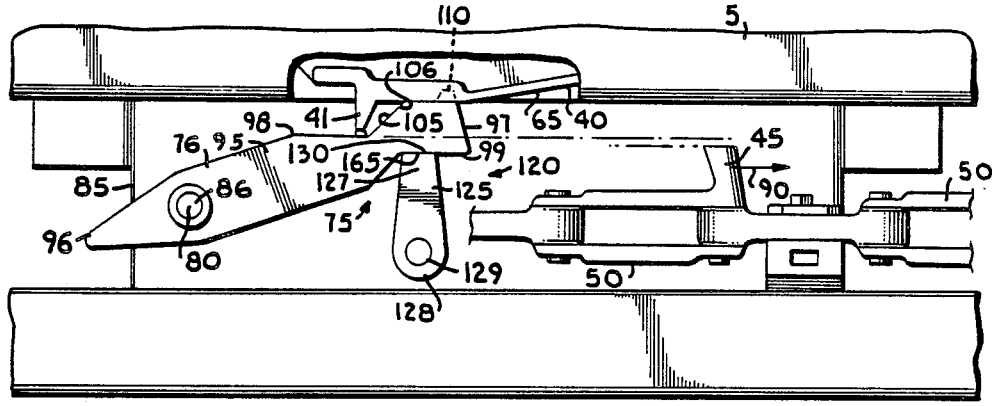
FIG. 5 is a view similar to FIG. 2 and illustrates the gravity retraction stop assembly engaging a trolley dog.

Referring to FIGS. 2 and 5, trolley dog 40 is mounted in the trolley 6 for pivoting about a pivot axis 60 as guided by a slot 61. The trolley dog 40 can be moved between a first position (FIG. 2) wherein it is engageable by drive dogs 45 and a second position (FIG. 5) wherein it is out of position for engagement by drive dogs 45. The trolley dog 40 includes a forward cam edge 65 which extends forwardly and upwardly from the downward extension 41. The instant trolley stop arrangement operates by providing an obstruction in the path of motion of the trolley 6 such that the obstruction will be engaged by the forward cam edge 65 to force the trolley dog 40 to pivot upwardly and lift the downward extension 41 above the drive dogs 45.

Figure 6:
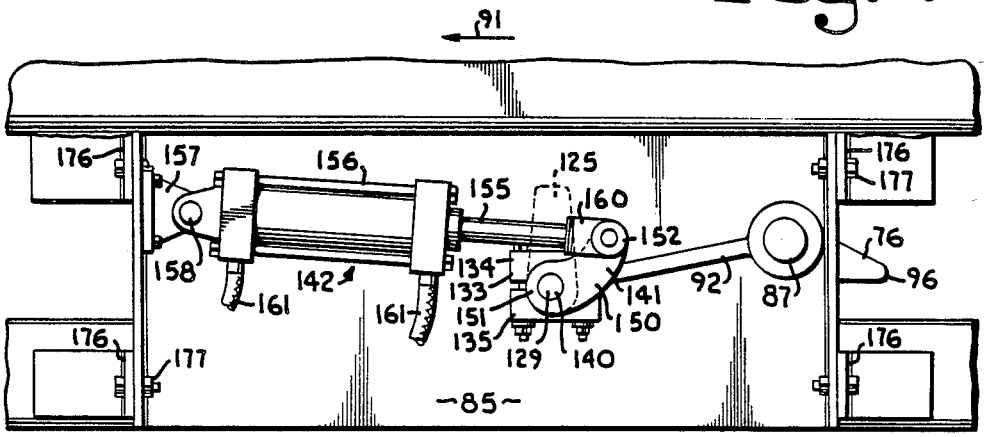
FIG. 6 is an enlarged fragmentary side elevational view of an actuating mechanism for the gravity retracted stop arm taken from an opposite side of the conveyor to that shown in FIG. 5 and with phantom lines indicating the position of an actuating cam of the mechanism in a stop arm raising position.

FIGS. 2–7 illustrate a gravity retraction trolley stop assembly 75 of which the positive retraction trolley stop mechanism 2 is an improvement. The mechanism 2 will be described in more detail below. Referring to FIG. 5, the trolley stop assembly 75 includes a stop arm 76 pivotally mounted in the assembly 75 for movement about transverse pivot axis 80. A frame member 85 is positioned beneath one side of the trolley track 5. The stop arm 76 is mounted on the frame member 85 by an axle 86 and bearing system 87 which extend through the frame member 85. FIGS. 5 and 6 show the assembly 75 from opposite sides of the frame member 85. Forward motion of the chain drive is represented in FIG. 5 by arrow 90 and in FIG. 6 by arrow 91. A web 92 is joined to frame member 85, by welding or the like, to stiffen same.

The stop arm 76 is an elongated arm 95 having a first end 96, a second end 97, a first or upper cam edge or surface 98, and a second or lower cam edge or surface 99. The stop arm 76 is mounted on the axle 86 and bearing arrangement 87 at a point adjacent the first stop arm end 96. Pivoting of the arm 76 about axis 80 can be provided either by a pivotal relationship between the arm 75 and the axle 86 or by a pivotal relationship between the axle 86 and the frame member 85. The illustrated arm 76 is affixed to the axle 86 which is rotatably mounted with respect to the frame member 85 by the bearing assembly 87. The stop arm 76 is pivotable between an upper trolley disengaging or braking position (FIG. 5) and a lower trolley engaged or non-braking position (FIG. 2). When the arm 76 is in the braking position, the cam surface 98 is positioned to engage the forward cam surface 65 of a trolley dog 40 on a passing trolley 6.

Means are provided to ensure positive braking engagement between the stop arm 76 and the trolley dog 40 when the trolley dog 40 has been lifted into the braking position. The cam surface 98 of the stop arm 76 includes an abutment portion 105 which is appropriately shaped to engage and mate with abutment portion 106 on the trolley dog forward cam surface 65 when the trolley dog 40 has been pushed upward into a position for braking. Once the abutment portions 105 and 106 engage or mate with one another, the trolley 6 will come to an abrupt stop. Positive trolley braking is further assisted by the provision of an upwardly extending knob 110 on a tip of the abutment portion 105.

Actuator means is provided to pivot the stop arm 76 between its braking and non-braking positions. An actuator mechanism 120 includes a cam member 125 which is an elongated finger 126 having a first end 127 and a second end 128. The cam member 125 is affixed to an axle 129 which is pivotally mounted on the frame member 85 by a bearing assembly 133. Pivoting occurs about a pivot axis 136 parallel to the pivot axis 80 of the stop arm 76. 128. The cam member 125 is oriented and sized to engage the lower cam surface 99 of the stop arm 76 by pivoting in one direction to move the stop arm 76 to its upper braking position. Pivoting of the cam member 125 in the opposite direction removes support for the stop arm 76 which is thereby allowed to assume its lower non-braking position under the influence of gravity. The cam member 125 tapers toward its first end 127 to provide an appropriate cam surface for interaction with the stop arm 76. The end 127 is provided with a flat surface 130 (FIG. 2) for stable support of the stop arm 76 in the braking position.

The bearing assembly 133 includes upper and lower block halves 134 and 135, one of which is attached to the frame member 85. An end 140 of the axle 129 has a crank arm 141 mounted thereon. As the crank arm 141 is pivoted by means of a piston and cylinder arrangement 142, the cam member 125 is pivoted. The crank arm 141 is a curved member 150 having a first end 151 and a second end 152. The crank arm 141 is mounted on the axle 121 at the first end 151 of the crank arm 141 The piston and cylinder arrangement 142 is a double acting piston 155 and cylinder 156 The cylinder 156 is pivotally connected to the frame member 85 by means of ear 157 and axle 158. The piston 155 has a first end 160 which is pivotally connected to the second end 152 of the crank arm 141. A pair of fluid lines 161 provide fluid under pressure to the cylinder 155. Alternatively, a pneumatic cylinder could be substituted for the hydraulic cylinder 155.

When the piston 155 is extended, the cam member 125 is pivoted to an arm raising position to support the stop arm 76 for engagement with a trolley dog 40 to disengage same from the drive dog 45 and to brake the trolley 6. When the piston 155 is retracted, the cam member 125 is pivoted to an arm releasing position permitting the stop arm 76 to lower out of possible engagement with a trolley dog 40.

Under certain circumstances it is desirable that the stop arm 76 be maintained in the braking position without the piston and cylinder arrangement 142 being pressurized. The lower cam surface 99 of the stop arm 76 includes a rest portion 165 which extends horizontally when the stop arm 76 is in its braking position. At this position the stop arm 76 is held up by the cam member 125 which does not tend to pivot due to its substantially vertical orientation and the engagement of the flat surface 130 of the cam 125 with the rest surface portion 165 of the stop arm 76. As a result, pressure may be taken off of the piston and cylinder arrangement 142 leaving the stop arm 76 retained in the upper braking position.

One of the advantages of the trolley stop assembly 75 is that, with respect to a side 170 of the track 5, the assembly 75 maintains a relatively narrow profile. The assembly 75 does not to jut substantially outward from underneath the track 5. Thus, it does not provide an inconvenient and potentially hazardous obstruction to workers passing by and near the side 170 of the conveyor system 1. The assembly 75 can be mounted at almost any point along a conveyor system 1. The frame member 85 is mounted on the track 5 by brackets 176 and bolts 177 or the like. The assembly 75 is accessible for maintenance and repair.

In operation of the trolley stop assembly 75 a trolley 6 is conveyed along track 5 by engagement between a drive dog 45 and the trolley dog 40. When braking is not desired, the trolley stop assembly 75 is oriented with the stop arm 76 lowered, the cam member 125 lowered, and the piston 155 retracted. When it is desired that a selected trolley be stopped by operation of the trolley stop assembly 75, the piston 155 is extended, pivoting the cam member 125 upward to lift the stop arm 76. The trolley dog 40 on the next trolley 6 travelling along the track 5 will be lifted until it disengages from the drive dog 45. The abutment portion 105 of the stop arm 76 engages the abutment portion 106 of the trolley dog 40, braking the trolley 6. In order to release an engaged trolley 6, for propulsion along the track 5 by the next available drive dog 45, the cam member 125 is pivoted by retraction of the piston 155 thereby lowering the stop arm 76. The trolley dog 40 will drop to its lower position for engagement by a next oncoming drive dog 45.

Figure 8:
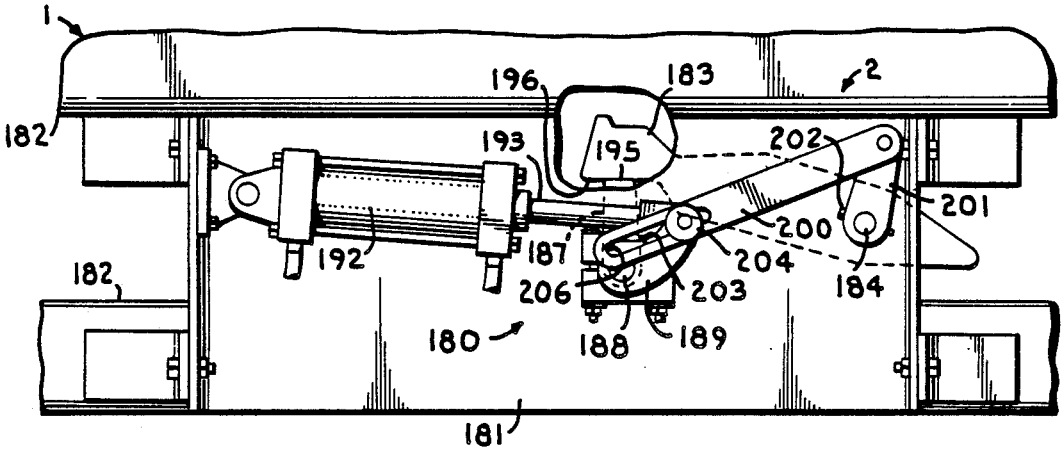
FIG. 8 is a view similar to FIG. 6 and illustrates a preferred embodiment of the positive retraction trolley stop mechanism embodying the present invention in the form of a slotted lost motion link with the stop arm shown in its upper trolley disengaging position.
Figure 9:
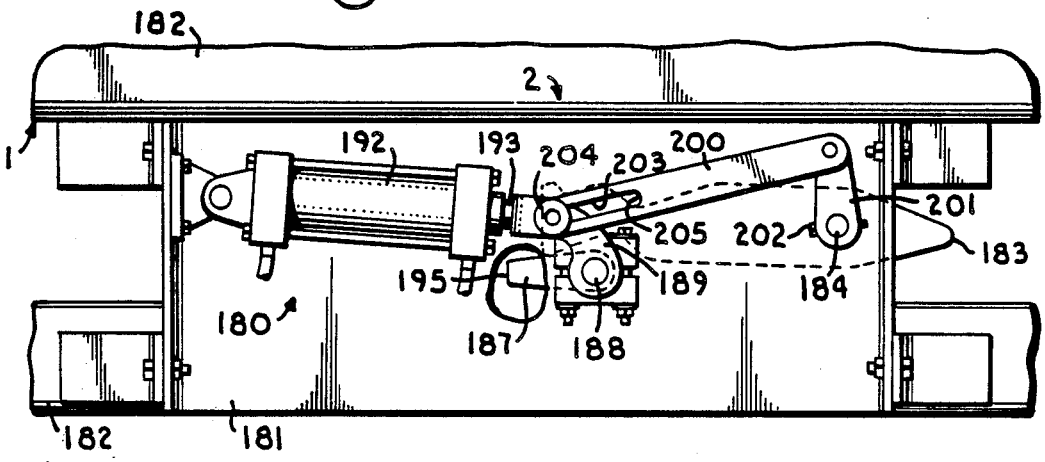
FIG. 9 is a view similar to FIG. 8 and illustrates the slotted lost motion link with the stop arm shown in its lower trolley engaged position.

FIGS. 8 and 9 illustrate a preferred embodiment 180 of the positive retraction trolley stop mechanism 2 of the present invention. The mechanism 180 is similar in many respects to the gravity retraction trolley stop mechanism 75 described above. The mechanism 180 is mounted on a support frame or plate 181 which is attached to trolley support rails 182 on which the trolleys 6 ride. A trolley stop arm 183 is affixed to a stop arm axle 184 which is pivotally mounted through the support plate 181. The stop arm 183 is shown in an upper trolley disengaging position in FIG. 8 in which it is oriented to cause the disengagement and braking of a passing trolley 6. FIG. 9 shows the stop arm 183 in a lower trolley disengaged position in which passing trolleys 6 are not affected by the stop arm 183.

A stop arm deployment cam member 187 is affixed to a cam shaft 188 which is pivotally mounted on the support plate 181 in a manner similar to the mounting of the cam member 125 to the support plate 85. A cam crank 189 is affixed to the cam shaft 188 at an opposite end from the cam member 187. A double acting hydraulic cylinder 192 is pivotally connected to the support plate 181 and has a piston rod 193 pivotally connected to an end of the cam crank 189. When the rod 193 is extended, the cam member 187 is pivoted from a stop arm releasing position (FIG. 9) to a stop arm raising position (FIG. 8) by way of the cam crank 189 and the cam shaft 188. This action positively raises the stop arm 183 to the trolley disengaging position.

The cam member 187 is provided with a flat surface 195 at an end thereof which engages a lower rest surface 196 of the stop arm 183 when the cam member 187 is vertically oriented in its arm raising position. Engagement between the flat surface 195 of the cam member 187 and the rest surface 196 of the stop arm 183 resists pivoting of the cam member 187 to some degree resulting in stable support of the stop arm 183 by the cam member 187 even if the cylinder 192 is unpressurized.

When the piston rod 193 is retracted, the cam member 187 is pivoted back to its arm releasing position whereby the stop arm 183 is free to assume its lower trolley disengaged position under the influence of gravity. In order to insure that the stop arm 183 actually returns to its lower position, the mechanism 180 is provided with a lost motion or one way link 200. The stop arm axle 184 has a stop arm crank 201 affixed thereto, as by a pin 202. The link 200 has one end pivotally connected to the stop arm crank 201 and has an elongated slot 203 formed in an opposite end. The link 200 is connected to the cam crank 189 by a link connector 204 mounted on the cam crank 189 and slidably engaged with the slot 203.

When the cam member 187 is pivoted to lift the stop arm 183, the link connector 204 slides along the slot 203 whereby the link 200 does not contribute to with the lifting of the stop arm 183 by the cam member 187. Additionally, the link 200 does not interfere with the stable support of the stop arm 183 in its upper position by the cam member 187. The slot 203 is long enough that the link connector 204 does not engage an inner end 205 of the slot 204. When the cam member 187 is pivoted to lower the stop arm 183, the link connector 204 slides along the slot 203 by pivoting of the cam crank 189 and engages an outer end 206 of the slot 203 whereby the cam crank 189 pulls the link 200 and the stop arm crank 201 therewith to pivot the stop arm 183 to its lower position. The stop arm 183 is, thus, positively retracted or lowered out of possible engagement by a passing trolley 6.

Figure 10:
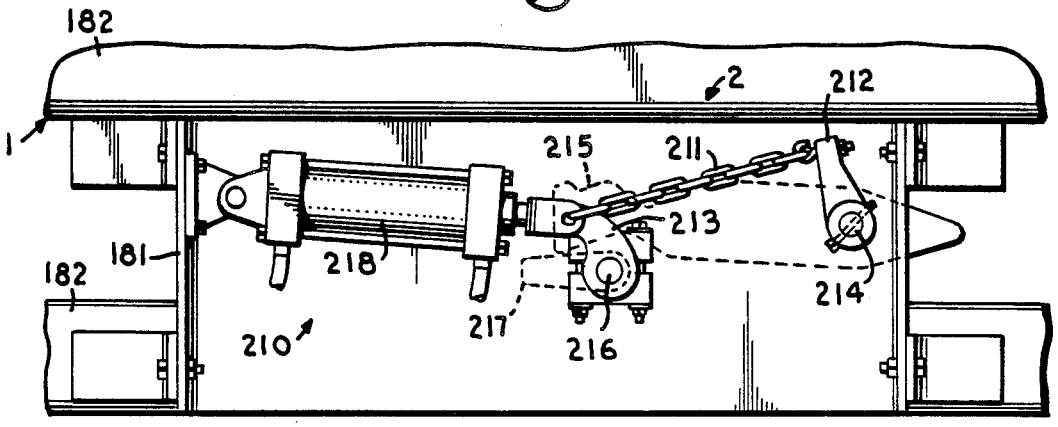
FIG. 10 is view similar to FIG. 8 and illustrates a modified embodiment of the positive retraction trolley stop mechanism in the form of a chain.

FIG. 10 illustrates a modified embodiment 210 of the positive retraction trolley stop mechanism 2. The mechanism 210 is substantially similar to the mechanism 180 except that the lost motion link 200 of mechanism 180 is replaced by a flexible tensile member or chain 211 which has a similar function. The chain 211 is connected between a stop arm crank 212 and a cam crank 213. The stop arm crank 212 is connected by a stop arm axle 214 to a stop arm 215. The cam crank 213 is connected by a cam shaft 216 to a cam member 217 which is pivoted by a hydraulic cylinder 218 to raise the stop arm 215 to an upper trolley disengaging position. When the cam member 217 is pivoted to a lower position, the stop arm 215 is released by the cam member 217 and positively pivoted to a lower trolley disengaged position by tension in the chain 211. Since the chain 211 is flexible and cannot be pushed, the chain 211 is only active in pulling the stop arm 215 to its lower position and does not contribute to with the raising of the stop arm 215 by the cam member 217 or interfere with the stable support of the stop arm 215 by the cam member 217. The chain 211, thus, has an analogous function to the lost motion link 200. The chain 211 could alternatively be replaced by a length of cable (not shown) or other type of flexible member.

It is to be understood that while certain embodiments of the present invention have been illustrated and described herein, the invention is not to be limited to the specific forms or arrangement of parts herein described and shown.

What is claimed and desired to be secured by Letters Patent is as follows:

1. A trolley stop mechanism for use in a trolley system including a mobile trolley with movable means engageable by a drive dog of a trolley drive arrangement to move the trolley along a track, said mechanism comprising:

(a) a frame member;

(b) a stop arm connected to on said frame member and movable between a trolley disengaging position to cause a trolley to disengage from a drive dog of a trolley drive mechanism and a trolley engaged position;

(c) stop arm motor means mounted on said frame member, engaged with said stop arm, and movable between a first position and a second position, said motor means positively urging said stop arm to said trolley disengaging position upon said motor means moving from said first position to said second position and releasing said stop arm to move to said trolley disengaged position upon said motor means moving from said second position to said first position; and (d) one way link means engaged between said stop arm and said stop arm motor means, said link means allowing movement of said stop arm to said trolley disengaging position without interference by said link means and causing positive positioning of said stop arm in said trolley engaged position when said motor means is moved from said second position to said first position.

2. A mechanism as set forth in claim 1 wherein:

(a) said stop arm is pivotally connected to said frame member and pivotable between said trolley disengaging position and said trolley engaged position.

3. A mechanism as set forth in claim 1 and including:

(a) a stop arm axle pivotally mounted on said frame and having said stop arm affixed thereto;

(b) a stop arm crank affixed to said axle; and (c) said link means being engaged between said stop arm crank and said stop arm motor means.

4. A mechanism as set forth in claim 3 and including:

(a) a link member pivotally connected to said stop arm crank and having an elongated link slot formed therein, said slot having opposite link ends; and (b) said stop arm motor means having a link connector engaging said link member through said slot in such a manner that said link connector slides along said slot when said motor means urges said stop arm to said trolley disengaged position and said link connector engages one of said link ends to positively move said stop arm to said trolley engaged position when said motor means moves from said second position to said first position.

5. A mechanism as set forth in claim 3 wherein said link means includes:

(a) flexible tensile means connected between said stop arm crank and said stop arm motor means.

6. A mechanism as set forth in claim 5 wherein:

(a) said flexible tensile means is a chain.

7. A trolley stop mechanism for use in a trolley system including a mobile trolley with a depending, movable trolley dog engageable in a lower position by an upwardly extending drive dog of a trolley drive arrangement for movement of the trolley along a track, said mechanism comprising:

(a) a frame member;

(b) a stop arm pivotally mounted on said frame member, including a lower rest surface, and pivotable between an upper trolley disengaging position to cause a trolley dog of a trolley to disengage from a drive dog of a trolley drive mechanism and a lower trolley engaged position;

(c) a cam member pivotally mounted on said frame member, engaging said stop arm rest surface, and pivoted between a substantially vertical stop arm raising position to urge said stop arm to said trolley disengaging position and a stop arm releasing position to release said stop arm to said trolley engaged position;

(d) cam motor means connected to said cam member and selectively activated to pivot said cam member between said arm releasing position and said arm raising position; and (e) one way link means engaged between said stop arm and said cam motor means, said link means allowing said cam member to move said stop arm to said trolley disengaging position without interference by said link means and positively positioning said stop arm in said lower trolley engaged position when said cam member is pivoted to said arm releasing position.

8. A mechanism as set forth in claim 7 and including:

(a) a stop arm axle pivotally mounted on said frame and having said stop arm affixed thereto;

(b) a stop arm crank affixed to said axle; and (c) said link means being engaged between said stop arm crank and said cam motor means.

9. A mechanism as set forth in claim 8 wherein:

(a) said cam member is positioned on a cam shaft pivotally mounted on said frame member;

(b) a cam crank is affixed to said cam shaft;

(c) said motor means includes a linear motor connected to said frame member and connected by said cam crank to said cam shaft to pivot said cam member between said stop arm raising and releasing positions; and (d) said link means is connected between said cam crank and said stop arm crank.

10. A mechanism as set forth in claim 8 and including:

(a) a link member pivotally connected to said stop arm crank and having an elongated link slot formed therein, said slot having opposite link ends; and (b) said cam motor means having a link connector engaging said link member through said slot in such a manner that said link connector slides along said slot when said motor means urges said stop arm to said trolley disengaged position and said link connector engages one of said link ends to positively move said stop arm to said trolley engaged position when said motor means moves said cam member from said stop arm raising position to said stop arm releasing position.

11. A mechanism as set forth in claim 8 wherein said link means includes:

(a) flexible tensile means connected between said stop arm crank and said cam motor means.

12. A mechanism as set forth in claim 11 wherein:

(a) said flexible tensile means is a chain.

13. A trolley stop mechanism for use in a trolley system including a mobile trolley with a depending, movable trolley dog engageable in a lower position by an upwardly extending drive dog of a trolley drive arrangement for movement of the trolley along a track, said mechanism comprising:

(a) a frame member;

(b) a stop arm pivotally mounted on said frame member, including a lower rest surface, and pivotable between an upper trolley disengaging position to cause a trolley dog of a trolley to disengage from a drive dog of a trolley drive mechanism and a lower trolley engaged position;

(c) a cam member pivotally mounted on said frame member, engaging said stop arm rest surface, and pivoted between a substantially vertical stop arm raising position to urge said stop arm to said trolley disengaging position and a stop arm releasing position to release said stop arm to said trolley engaged position;

(d) cam motor means connected to said cam member and selectively activated to pivot said cam member between said arm releasing position and said arm raising position;

(e) said cam member being configured to cooperate with said rest surface of said stop arm to provide stable support to said stop arm to thereby maintain said stop arm in said upper trolley disengaging position without said cam motor means being active; and (f) one way link means engaged between said stop arm and said cam motor means, said link means allowing said cam member to move said stop arm to said trolley disengaging position without interference by said link means and positively positioning said stop arm in said lower trolley engaged position when said cam member is pivoted to said arm releasing position.

14. A mechanism as set forth in claim 13 wherein said cam member includes:

(a) a cam end including a flat surface which is engaged by said rest surface of said stop arm when said cam member is in said substantially vertical stop arm raising position to maintain said stop arm in said trolley disengaging position without said cam motor means being active.

15. A mechanism as set forth in claim 13 and including:

(a) a stop arm axle pivotally mounted on said frame and having said stop arm affixed thereto;

(b) a stop arm crank affixed to said axle; and (c) said link means being engaged between said stop arm crank and said cam motor means.

16. A mechanism as set forth in claim 15 wherein:

(a) said cam member is positioned on a cam shaft pivotally mounted on said frame member;

(b) a cam crank is affixed to said cam shaft;

(c) said motor means includes a double acting fluid cylinder connected to said frame member and connected by said cam crank to said cam shaft to pivot said cam member between said stop arm raising and releasing positions; and (d) said link means is connected between said cam crank and said stop arm crank.

17. A mechanism as set forth in claim 15 and including:

(a) a link member pivotally connected to said stop arm crank and having an elongated link slot formed therein, said slot having opposite link ends; and (b) said cam motor means having a link connector engaging said link member through said slot in such a manner that said link connector slides along said slot when said motor means urges said stop arm to said trolley disengaged position and said link connector engages one of said link ends to positively move said stop arm to said trolley engaged position when said motor means moves said cam member from said stop arm raising position to said stop arm releasing position.

18. A mechanism as set forth in claim 15 wherein said link means includes:

(a) flexible tensile means connected between said stop arm crank and said cam motor means.

19. A mechanism as set forth in claim 15 wherein:

(a) said flexible tensile means is a chain.

20. A mechanism as set forth in claim 13 wherein:

(a) said stop arm is mounted on said frame member to pivot about a substantially horizontal stop arm axis which is substantially transverse to a track on which a trolley engageable with said stop arm moves.

21. A mechanism as set forth in claim 13 wherein said stop arm includes:

(a) an abutment which engages a trolley dog of a trolley to stop said trolley in said trolley disengaging position of said stop arm.

* * * * *